US006012430A

United States Patent [19]

Cooke

[11] Patent Number: 6,012,430

[45] Date of Patent: Jan. 11, 2000

[54] FUEL INJECTOR

[75] Inventor: Michael Peter Cooke, Kent, United Kingdom

[73] Assignee: Lucas Industries, Solihull, United Kingdom

[21] Appl. No.: 09/107,943

[22] Filed: Jun. 30, 1998

[30] Foreign Application Priority Data

Jan. 7, 1997 [GB] United Kingdom ..... 9713791

[51] Int. Cl.[7] ..... F02M 37/04

[52] U.S. Cl. ..... 123/467; 123/506; 239/96

[58] Field of Search ..... 123/447, 467, 123/506; 239/88, 96, 585.1

[56] References Cited

U.S. PATENT DOCUMENTS 5,526,792 6/1996 Guth et al. ..... 123/467
5,901,685 5/1999 Noyce et al. ..... 123/467
5,913,300 6/1999 Drummond ..... 123/506
5,915,361 6/1999 Heinz et al. ..... 123/467
5,941,215 8/1999 Augustin ..... 123/467

*Primary Examiner*—Thomas N. Moulis
*Attorney, Agent, or Firm*—Price, Heneveld, Cooper, DeWitt & Litton

[57] ABSTRACT

A fuel injector comprises a valve needle biased into engagement with a seating by a spring, a fuel supply line arranged to permit fuel under pressure to be supplied towards the seating, a control chamber communicating through a restricted flow passage with the supply line, and a control valve arranged to control the fuel pressure within the control chamber, wherein the control chamber is defined, in part, by a surface associated with the valve needle, the surface being orientated such that the application of high pressure fuel to the control chamber applies a force to the surface acting in a direction opposing the action of the spring on the valve needle.

8 Claims, 2 Drawing Sheets

FUEL INJECTOR

Figure 1:
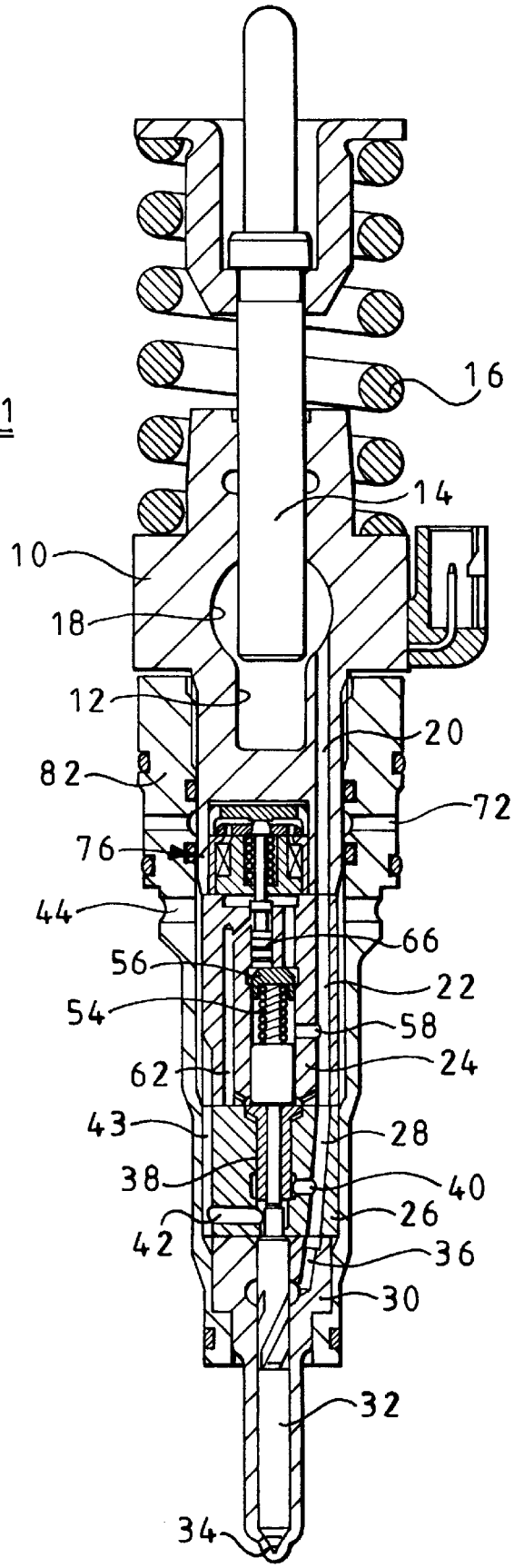

This invention relates to a fuel injector for use in supplying fuel to a cylinder of an internal combustion engine. In particular, the invention relates to an injector of the type capable of supplying a pilot injection in which a relatively small quantity of fuel is delivered followed by a main injection of fuel.

Conventional pump/injectors have the disadvantages that fuel pressure is dependent upon the quantity of fuel supplied thereto and upon the engine speed, and that electronic control of pilot injection is not possible or is difficult to achieve over the full range of engine speeds as a result of the spill valve being unable to move sufficiently quickly, in use. It is an object of the invention to provide a fuel injector, for example in the form of a pump/injector, in which these disadvantages are reduced.

According to the present invention there is provided a fuel injector comprising a valve needle biased into engagement with a seating by a spring, a fuel supply line arranged to permit fuel under pressure to be supplied towards the seating, a control chamber communicating through a restricted flow passage with the supply line, and a control valve arranged to control the fuel pressure within the control chamber, wherein the control chamber is defined, in part, by a surface associated with the valve needle, the surface being orientated such that the application of high pressure fuel to the control chamber applies a force to the surface acting in a direction opposing the action of the spring on the valve needle.

The injector preferably further comprises a fuel pressure actuable spill valve operable to control communication between the supply line and a fuel reservoir, the spill valve being actuable under the action of the fuel pressure within the control chamber.

Preferably, the spill valve comprises a valve member arranged to engage an associated seating when the fuel pressure within the control chamber exceeds a first predetermined level, the valve needle being arranged to lift from its seating when the fuel pressure within the control chamber exceeds a second, higher, predetermined level.

As the spill valve is closed at pressures lower than the pressure required to commence injection, appropriate operation of the control valve can be used to initiate a pilot injection followed by a main injection without requiring movement of the spill valve between the pilot and main injections. By using a fast acting electromagnetically actuated valve as the control valve, the pilot and main injections can be controlled electronically, and as the pilot and main injections are not controlled using the spill valve, the rate of movement of the spill valve does not hamper control of the pilot and main injections.

The fuel injector conveniently takes the form of a pump/injector in which a fuel pump is mounted directly upon the injector. Alternatively, the injector may be used in a fuel system in which the injector receives fuel from a separate high pressure fuel pump.

Figure 2:
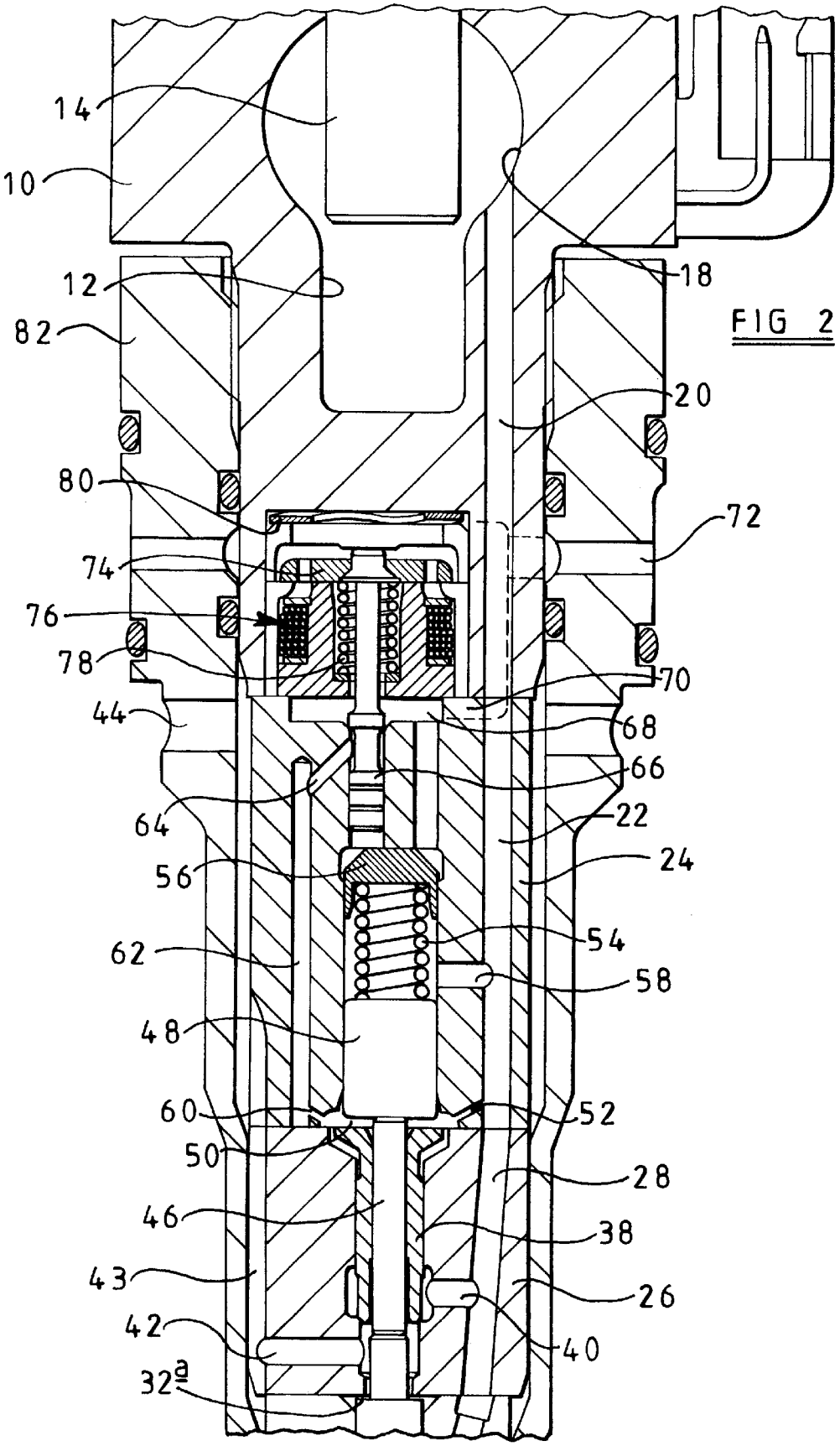

The invention will further be described, by way of example, with reference to the accompanying drawings, in which:

FIG. 1 is a sectional view of a pump/injector constituting an embodiment of the invention; and FIG. 2 is an enlarged view of part of the pump/injector of FIG. 1.

The pump injector illustrated in FIGS. 1 and 2 comprises a pump housing 10 having a cylindrical blind bore 12 provided therein within which a pumping plunger 14 is reciprocable under the action of a cam arrangement (not shown) and return spring 16. The bore 12 is shaped so as to include an annular gallery 18 which acts, together with the bore 12, to define an accumulator for occupation by fuel under high pressure, in use. The accumulator communicates through a passage 20 provided in the pump housing 10 with a passage 22 provided in a control valve housing 24 which abuts the pump housing 10.

The control valve housing 24 abuts a spill valve housing.26 which includes a passage 28 which communicates with the passage 22. The spill valve housing 26 abuts a nozzle body 30 which is provided with a blind bore within which a valve needle 32 is slidable. The valve needle 32 is engageable with a seating defined adjacent the blind end of the bore to control the supply of fuel past the seating to one or more outlet apertures 34.

The blind bore includes a region of increased diameter defining an annular gallery which communicates through a passage 36 with the passage 28 provided in the spill valve housing 26. As illustrated in FIG. 1, the valve needle 32 includes a region of diameter substantially equal to ten diameter of the blind bore, and this region of the needle 32 is provided with flutes which permit fuel to flow from the annular gallery towards a region of the valve needle 32 of reduced diameter. It will be appreciated that fuel is able to flow between the region of the valve needle 32 of reduced diameter and the blind bore towards the seating. The passages 20, 22, 28 and 36 define a supply line whereby, in use, fuel is supplied under pressure from the accumulator towards the seating, and when the valve needle 32 is lifted from the seating, to the outlet apertures 34.

The spill valve housing 26 is provided with an axially extending through bore within which a spill valve member 38 is slidable. The through bore defines a seating with which the spill valve member 38 is engageable to control fuel flow between a passage 40 which communicates with the supply line and a spill passage 42 which communicates via a groove 43 provided in the spill valve housing 26 with a spill port 44. The spill valve member 38 is of tubular form, and a rod 46 extends through the axial passage defined by the spill valve member 38, the rod 46 being of piston-like fit within the spill valve member 38. The rod 46 abuts an end of the valve needle 32, and thus is moveable with the valve needle 32.

The end of the rod 46 remote from the valve needle 32 engages a piston member 48 which is slidable within a cylindrical bore provided in the control valve housing 24. The end of the bore adjacent the spill valve housing 26 is of increased diameter, and defines, with the end of the through bore provided in the spill valve housing 26, a control chamber 50 which communicates through a restricted passage 52 with the supply line. The end of the piston 48 remote from the rod 46 engages a spring 54 which, in turn, engages a cap 56 which is in sealing engagement within the bore of the control valve housing 24. The cap 56, piston 48 and bore provided in the control valve housing 24 define a spring chamber which communicates through a passage 58 with the supply line. Clearly, the force of the spring 54 is transmitted through the piston 48 and rod 46 to the valve needle 32 to bias the valve needle 32 into engagement with its seating. Movement of the valve needle 32 away from its seating is limited by the engagement of a shoulder 32*a* provided on the valve needle 32 with the lower surface of the spill valve housing 26. Throughout the range of movement of the valve needle 32, movement of the spill valve member 38 is not impeded, movement of the spill valve member 38 away from its seating being limited only by the engagement of the upper end of the spill valve member 38 with the lower surface of the control valve housing 24.

The control chamber 50 communicates through a restricted passage 60 with an axially extending passage 62. The axially extending passage 62 communicates with an angled passage 64 which communicates with a bore of relatively small diameter extending from the end of the control valve housing 24 adjacent the pump housing 10 to the bore within which the piston 48 is slidable. A control valve member 66 is slidable within the bore and engageable with a seating to control communication between the passage 64 and a chamber 68 defined between the pump housing 11 and the control valve housing 24. The chamber 68 communicates through a passage 70 which is out of the plane illustrated in FIG. 2 and is hence indicated by dashed lines, with a back leak connector port 72.

The valve member 66 is secured to an armature 74 which is moveable under the influence of the magnetic field generated by an electromagnetic actuator 76. A spring 78 is provided to bias the valve member 66 away from its seating. As illustrated in FIG. 2, the actuator 76 and armature 74 are located within a recess provided in the end face of the pump housing 10, the actuator 76 being trapped in the recess by engagement with the end face of the control valve housing 24, a spring 80 in the form of a wave washer or disc spring ensuring that the actuator 76 remains in engagement with the end face of the control valve housing 24.

The nozzle body 30, spill valve housing 26 and control valve housing 24 are secured to the pump body 10 by means of a cap nut 82 which is in screw-threaded engagement with the pump housing 10, the cap nut 82 defining the spill port 44 and back leak connector port 72.

In use, in the position illustrated in the accompanying drawings, the plunger 14 occupies a retracted position, the accumulator being charged with fuel at relatively low pressure. The spill valve member 38 is lifted from its seating, and the control valve member 66 is lifted from its seating. As the spill valve member 38 is lifted from its seating, the fuel pressure within the supply line is relatively low, hence the fuel pressure applied to the valve needle 32 is insufficient to lift the valve needle 32 away from its seating against the action of the spring 54. As the valve needle 32 is in engagement with its seating, injection is not taking place. From this position, inward movement of the plunger 14 results in fuel being displaced from the accumulator through the supply line, and past the spill valve to the spill port 44. Fuel from the spill port 44 is returned to a low pressure fuel reservoir. A small amount of fuel is also displaced through the restricted passage 52 to the control chamber 50, and from the control chamber 50 through the passage 62, past the control valve member 66 to the back leak connector port 72. As fuel is able to flow past the spill valve to the spill port 44, the inward movement of the plunger 14 does not significantly increase the fuel pressure within the supply line, thus fuel injection does not commence.

In order to commence injection, the actuator 76 is energised to cause the control valve member 66 to move against the action of the spring 78 into engagement with its seating. Such movement of the control valve member 66 breaks the communication between the control chamber 50 and the back leak connector port 72, thus the continued flow of fuel through the restricted passage 52 results in the fuel pressure within the control chamber 50 increasing. The restriction to the flow of fuel resulting from the provision of the passages 28, 40 together with the restriction to flow across spill valve seat results in the fuel pressure acting on the lower end of the spill valve member 38 being lower than that within the control chamber 50, and a point will be reached beyond which the pressure difference is sufficient to cause the spill valve member 38 to move into engagement with its seating thus terminating the flow of fuel from the supply line to the spill port 44.

Continued inward movement of the plunger 14 results in the fuel pressure within the accumulator and supply line increasing, and as the control chamber 50 communicates through the restricted passage 52 with the supply line, the fuel pressure within the control chamber 50 also increases. It will be appreciated that the application of high pressure fuel to the control chamber 50 applies a force to the piston 48 acting against the action of the spring 54, thus assisting movement of the valve needle 32 away from its seating. As the fuel pressure within the control chamber 50 and the pressure applied to the valve needle 32 increases, a point will be reached beyond which the pressure in the control chamber 50 and the pressure acting on the valve needle 32 are sufficient to overcome the action of the fuel pressure within the spring chamber and the action of the spring 54 resulting in movement of the valve needle 32 away from its seating. The movement of the valve needle 32 from its seating commences injection.

In order to terminate injection, the actuator 76 is de-energised resulting in the control valve member 66 moving under the influence of the spring 78 away from its seating. Such movement of the control valve member 66 permits communication between the control chamber 50 and the back leak connector port 72 resulting in a reduction in the fuel pressure within the control chamber 50. The reduction in the pressure within the control chamber 50 results in a reduction in the force maintaining the valve needle 32 in its lifted position, and as the pressure within the control chamber 50 falls, a point will be reached beyond which the valve needle 32 moves into engagement with its seating thus terminating injection.

It will noted from FIG. 2 that a relatively large proportion of the area of the lower end of the spill valve member 38 is exposed to the fuel pressure at the spill port 44. As this pressure is low, the force urging the spill valve member 38 away from its seating is also relatively low, and the fuel pressure within the control chamber 50 is sufficient to maintain the spill valve member 38 in engagement with its seating. As the spill valve member 38 is maintained in engagement with its seating, the pressure within the supply line is maintained at a high level.

Where the pump injector is to be used in a fuel system requiring a pilot injection followed by a main injection, in order to commence the main injection, the actuator 76 is energised once more, thus returning the control valve member 66 into engagement with its seating. Such movement of the control valve member 66 breaks communication between the control chamber 50 and back leak connector port 72 thus the fuel pressure within the control chamber 50 increases due to the connection of the control chamber 50 with the supply line through the restricted passage 52- As described hereinbefore, the increase in the pressure within the control chamber 50 subsequently causes commencement of the main injection. The main injection is terminated by de-energising the actuator 76 as described hereinbefore.

After injection has been terminated, if the actuator 76 is allowed to remain in its de-energised state for a relatively long period of time, the pressure within the control chamber 50 falls to a sufficiently low level that the spill valve member 38 is allowed to lift from its seating under the action of the high pressure fuel upon the exposed part of the lower end of the spill valve member 38, such movement of the control valve member 38 allowing fuel to flow from the supply line to the spill port 44. Continued inward movement of the plunger 14 displaces fuel from the accumulator through the supply line to the spill port 44. Subsequently, the pumping plunger 14 is retracted from the bore under the action of the return spring 16, such movement of the plunger 14 drawing fuel from the reservoir connected to the spill port 44 past the spill valve to the supply line and accumulator thus charging the accumulator with fuel at relatively low pressure ready for the commencement of the next injection cycle.

If desired, the control valve may be pulsed closed one or more times prior to the desired instant of commencement of injection. Such closure of the control valve results in the fuel pressure within the control chamber rising to a sufficiently high level to close the spill valve but insufficient to cause commencement of injection thus allowing the pressure in the accumulator to rise to the desired level before injection commences. It will be appreciated, therefore, that the injection pressure can be controlled independently of engine speed. By modifying the shape and size of the accumulator, the rate at which the pressure increases can be modified, and the accumulator can be arranged to ensure that, should the spill valve become jammed closed, the accumulator pressure will not rise to a sufficiently high level to cause damage to the injector.

As the quantity of fuel which passes the control valve, in use, is small, the electromagnetically controlled valve of the illustrated embodiment may be replaced by other suitable valves, for example a valve operable under the control of a piezoelectric stack.

Although the description hereinbefore is of a pump/injector, it wail be appreciated that the invention may be incorporated in injectors of other forms, for example injectors intended to receive fuel from a separate high pressure fuel pump.

I claim:

1. A fuel injector comprising a valve needle biased into engagement with a seating by a spring, a fuel supply line arranged to permit fuel under pressure to be supplied towards the seating, a control chamber communicating through a restricted flow passage with the supply line, and a control valve arranged to control the fuel pressure within the control chamber, wherein the control chamber is defined, in part, by a surface associated with the valve needle, the surface being orientated such that the application of high pressure fuel to the control chamber applies a force to the surface acting in a direction opposing the action of the spring on the valve needle.

2. A fuel injector as claimed in claim 1, further comprising a fuel pressure actuable spill valve operable to control communication between the supply line and a fuel reservoir, the spill valve being actuable under the action of the fuel pressure within the control chamber.

3. A fuel injector as claimed in claim 2, wherein the spill valve comprises a valve member arranged to engage an associated seating when the fuel pressure within the control chamber exceeds a first predetermined level, the valve needle being arranged to lift from its seating when the fuel pressure within the control chamber exceeds a second, higher, predetermined level.

4. A fuel injector as claimed in claim 1, wherein the control valve is controlled using an electromagnetic actuator.

5. A fuel injector as claimed in claim 1, wherein the surface associated with the valve needle is defined by a surface of a piston, movement of the piston being transmitted to the needle.

6. A fuel injector as claimed in claim 5, wherein the spring engages the piston.

7. A fuel system comprising a fuel injector as claimed in claim 1, and a fuel pump arranged to supply fuel exclusively to the fuel injector.

8. A fuel system as claimed in claim 7, wherein the fuel injector is mounted upon the fuel pump.

* * * * *